US005129452A

United States Patent [19]

Wilson

[11] Patent Number: 5,129,452

[45] Date of Patent: Jul. 14, 1992

[54] FLEXIBLE ELECTRICAL SUBMERSIBLE MOTOR PUMP SYSTEM FOR DEVIATED WELLS

[75] Inventor: Brown L. Wilson, Tulsa, Okla.

[73] Assignee: Oil Dynamics, Inc., Tulsa, Okla.

[21] Appl. No.: 734,064

[22] Filed: Jul. 22, 1991

Related U.S. Application Data

[63] Continuation of Ser. No. 483,642, Feb. 23, 1990, abandoned.

[51] Int. Cl.[5] ..... E21B 17/02

[52] U.S. Cl. ..... 166/66.4; 166/242; 285/363

[58] Field of Search ..... 166/242, 65.1, 66.4, 166/105, 243; 285/89, 340, 363, 405

[56] References Cited

U.S. PATENT DOCUMENTS

| | | | |
|---|---|---|---|
| 2,943,870 | 7/1960 | Davis | 285/363 |
| 3,624,822 | 11/1971 | Carle | 166/105.5 |
| 3,650,550 | 3/1972 | West | 285/363 |
| 4,616,704 | 10/1986 | Johnston | 166/242 |
| 4,753,291 | 6/1988 | Smith et al. | 166/65.1 |
| 4,771,830 | 9/1988 | Peate | 166/250 |

*Primary Examiner*—Terry Lee Melius
*Attorney, Agent, or Firm*—Head & Johnson

[57] ABSTRACT

Apparatus is provided to protect an electric submersible motor/pump (ESP) assembly as the normally rigid assembly is inserted into deviated or curved subterranean wells, i.e. directionally or horizontally drilled wells, which apparatus includes flexible joint connection means and cable protection devices.

23 Claims, 5 Drawing Sheets

FLEXIBLE ELECTRICAL SUBMERSIBLE MOTOR PUMP SYSTEM FOR DEVIATED WELLS

This is a continuation of copending application Ser. No. 07/483,642 filed on Feb. 23, 1990 now abandoned.

BACKGROUND

Subterranean hydrocarbon wells have been traditionally thought of as being straight and vertical. However in many cases the wells possess some deviation from vertical, as this is almost impossible to avoid when drilling with pressure on the drill bit as it passes relative soft and hard formations. Slight doglegs are, in most instances, of little concern in the design and placement of the production equipment. With the advent of modern drilling techniques, wells are purposely deviated through large angles in order to penetrate the formation at a desired angle. Two of these methods of drilling are directionally drilled wells and horizontally drilled wells.

The directionally drilled well is typically started from a small area where a number of wells are clustered. Such wells were drilled vertically for a short distance, then 'kicked off' and the 'kick off angle' increased to achieve a desired run angle. The drilling continues substantially straight at the established run angle until it approaches the targeted zone or formation. The angle is usually decreased and the hole allowed to drop into the target zone. Typically the rate at which angle is built in these wells seldom greater than 7 degrees per one hundred feet.

The horizontal well is drilled for the purpose of penetrating the formation in a direction parallel to the formation rather than passing through it vertically. Such a well allows a much greater drain area. A horizontal well is accomplished by drilling vertically until the hole approaches the formation. The hole is then deviated until the hole runs parallel through the formation. Such wells are classified by the radius or "dogleg angle" that is used in intercepting the formation. The dogleg in a deviated casing is found by measuring the angle off of vertical at locations of interest along the run of the casing. These measured angles and the distance separating their location are used to calculate the "dog leg" angle and are expressed in degrees of change per one hundred feet of casing in that area. For example, the following radii are typical:

| DISTANCE | DOG LEG ANGLE |
|---|---|
| Short 30–45', | 126–191 degrees per 100 feet |
| Medium 300–500', | 18.8–11.5 degrees per 100 feet |
| Long 1200–1500', | 4.8–3.8 degrees per 100 feet |

This assumes that the path of the casing can be represented by an assembly of circular arcs of various radii. The actual deflection of the center of a length of casing can be calculated by the following approximation:

$$d=2.6(L/100)2\times a.$$

Where:

d = deflection of section (inches)

L = Length of section (ft)

a = Dogleg Angle (deg/100 ft).

For those wells either deviated unintentionally or purposely directed either directionally or horizontally the drill pipe can usually pass easily through such deviations without damage, since a long string of drill pipe is quite flexible.

In many completed wells it is desirable to use a high flow capacity pumping system such as a submersible electric motor powered centrifugal pump (ESP). A typical ESP comprises different functional and separate parts; to-wit, a motor, an equalizer or sealing section, in some instances a gas separator, and a pump bolted together with flange joints. The motor rotatably drives a longitudinal and axial shaft which extends from the motor to the pump. Such systems are shown in U.S. Pat. No. 3,624,822 and Oil Dynamics Catalog ODI-1 (1986) "Total Pumping Systems". The purpose for such flange connected parts is for ease of shipping, field assembly, disassembly, and repair. However, to insert such an ESP system into a deviated well creates stress on the flanged joints. Because the flange type joints are weaker in bending than the rest of the unit, bending tends to concentrate in the weakest points with deflection and sometimes permanent deformation of the joint. If the yield strength of the material at the joint is exceeded, the unit will be permanently damaged. If the joint becomes damaged, it will put additional side load on the adjacent shaft bearing, drastically reducing the life of the equipment. To eliminate damage to the flange joint, its strength would have to equal the strength of the rest of the connected units. If such could be accomplished, the next weakest link, the bolts, would yield. Thus, the bolts would be stretched beyond their elastic limit.

There is yet a further consideration in inserting an ESP into and through the radius or arc of a deviated well. The cable which supplies the electrical power from the surface power supply must pass by the outside of the pump in order to reach the motor. It is attached to the outside of the pump and its connecting production tubing. As the ESP is pushed through the radius portion of the hole, it is important that the power cable is not pinched between the ESP and the well bore or casing. Heretofore to protect the cable in any type of well 'cable guards' have been used. One such type uses a channel that covers the cable for its entire exposed length. Another method uses sets of 'stand-offs' that are placed at the flange joints where the sections of the ESP ar bolted together. Such protectors are valid for most vertical wells but not for the severe bends of deviated wells.

SUMMARY OF THE INVENTION

This invention has as a primary object to provide a means of connecting the various parts of an ESP such that it may traverse through a deviated well without damaging the connecting joints or the various parts of the ESP including the power cable.

A further object of this invention is to provide flexible connecting joints between the functional parts of an ESP, so that the assembly can be safely inserted into a deviated well.

Another object of the invention is to provide a means for protecting the power cable from being pinched as an ESP system traverses a deviated or curved portion of a well bore. Specifically, means is provided to cause the ESP system to partially rotate or roll, forcing the cable side of the ESP system to be directed away from contact with the well bore.

Specifically the invention is directed to a flexible joint particularly useful in connecting longitudinal parts which are to be inserted into a deviated well. The joint comprises first and second members to be connected. The first member has a plurality of circularly spaced and threaded openings. The second member also has a plurality of circularly spaced openings which become axially aligned with the threaded holes in the first member. The two members are connected together by a plurality of threaded bolts into each axially aligned opening. Each of the bolts has a bolt head, beneath which is at least one Bellville spring washer which in the assembled and connected position is under yieldable compression. The invention also provides a rollover cable protector means which in combination with the flexible joint creates a total ESP system capable of use in deviated wells.

These and other objects of the invention will become more apparent upon further reading of the specification, claims and drawings herein.

DETAILED DESCRIPTION OF THE PREFERRED EMBODIMENTS

Before explaining the present invention in detail, it is to be understood that the invention is not limited in its application to the details of the construction and arrangement of parts illustrated in the accompanying drawings. The invention is capable of other embodiments and of being practiced or carried out in a variety of ways. It is to be understood that the phraseology and terminology employed herein is for the purpose of description and not of limitation.

Figure 2:
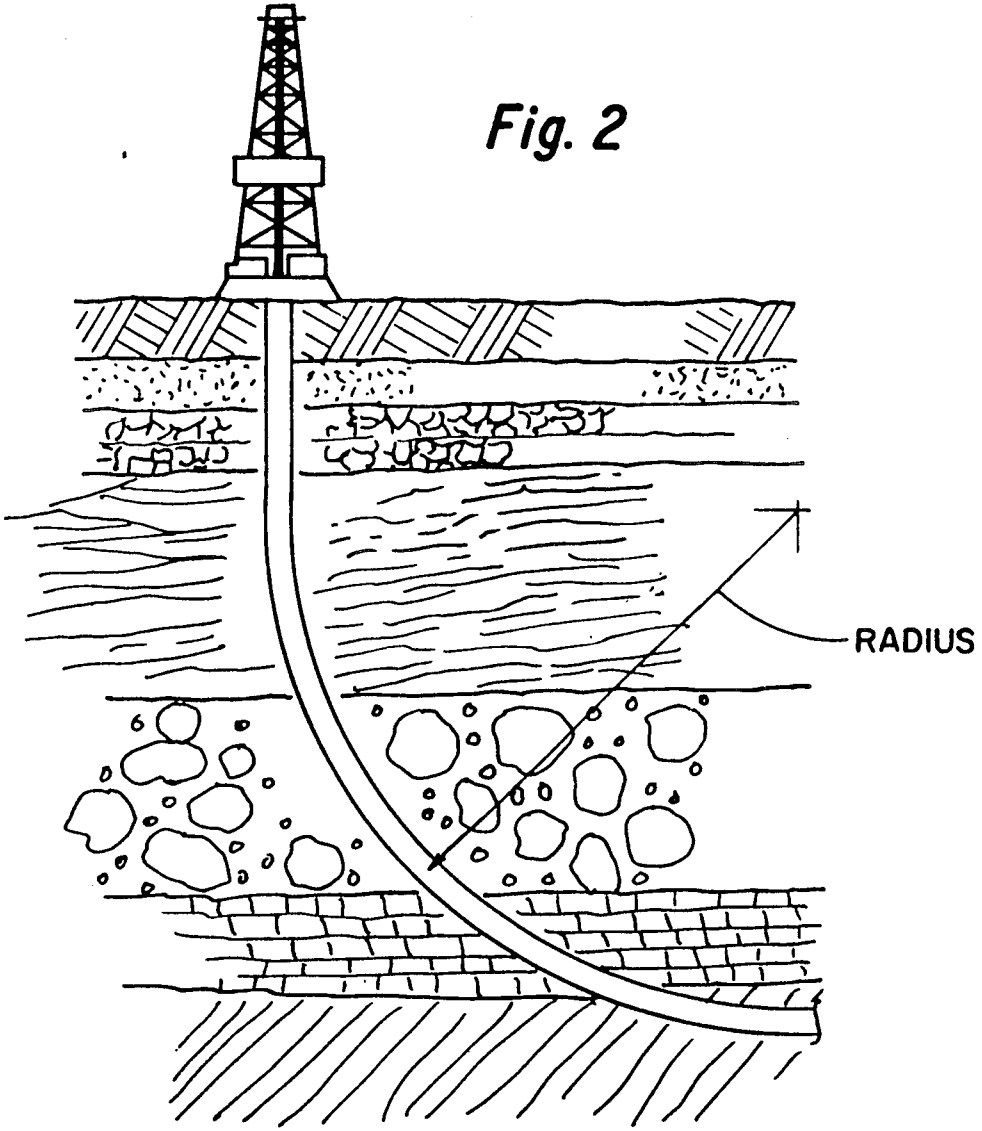
FIG. 2 is a sectional view of a horizontally drilled well.
Figure 1:
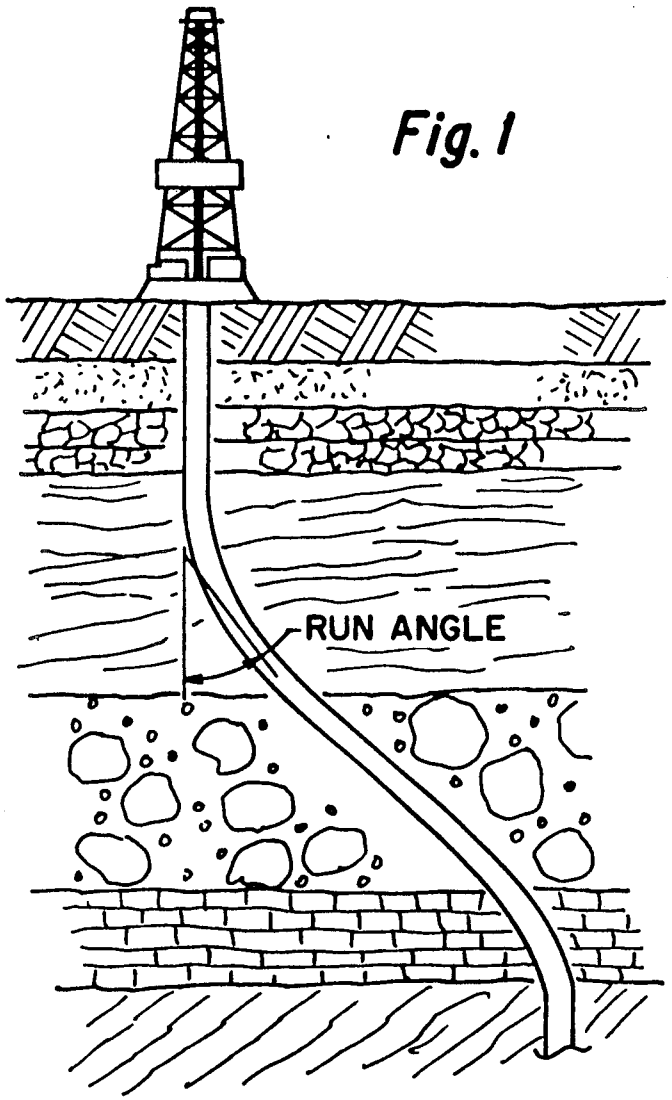
FIG. 1 is a sectional view of a directionally drilled well.

FIGS. 1 and 2 are sectional views to describe and show respectively a directional type well and a horizontal well, both of which must be able to accept fluid producing equipment such as an ESP without damage as the equipment traverses the curved or deviated portions.

Figures 3, 7:
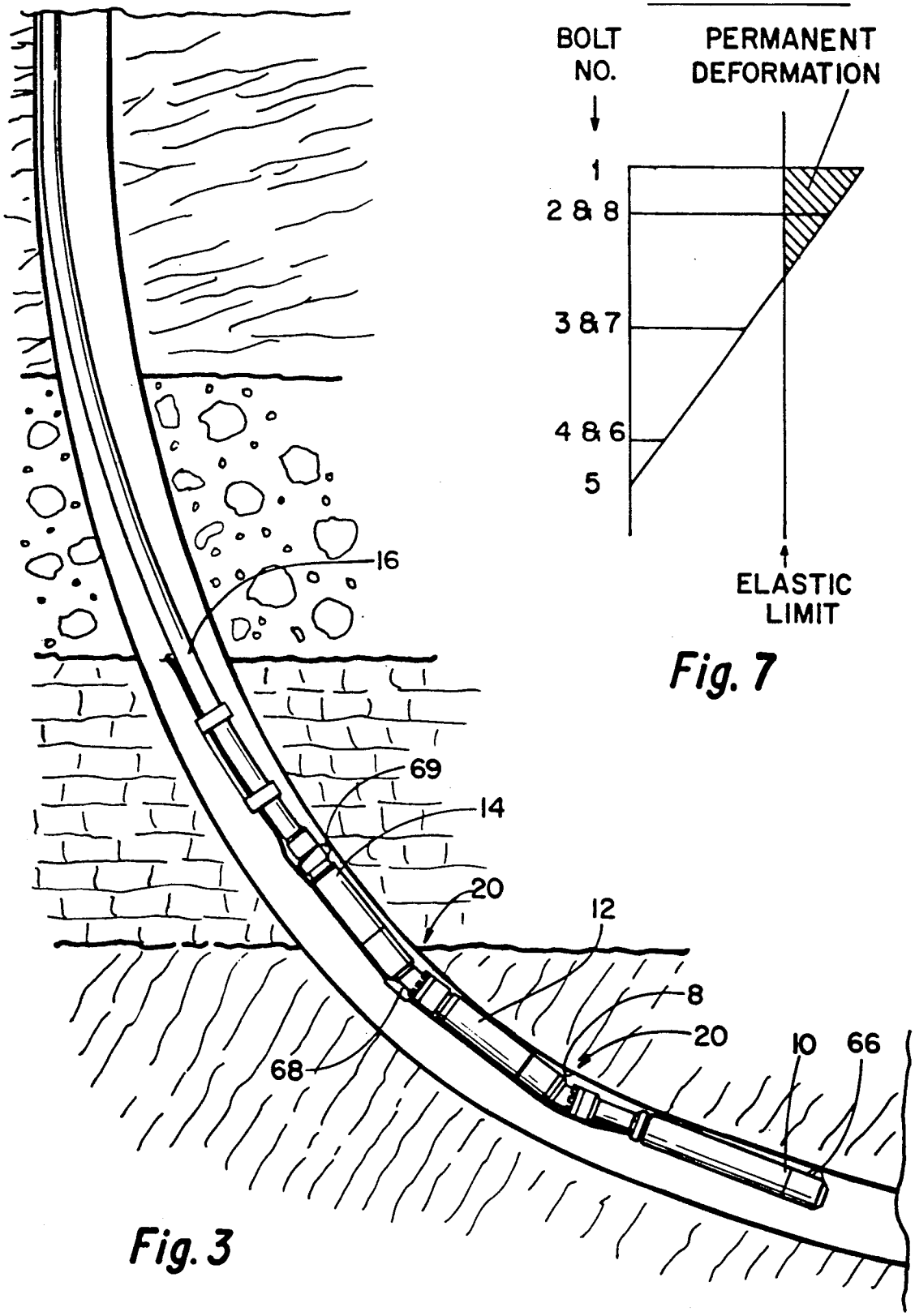
FIG. 3 is a partial sectional view of a multiple jointed ESP unit as it traverses a deviated or curved portion of the well.
FIG. 7 is a diagrammatic chart of bolt stretch limits as a joint of this invention traverses a curve during its insertion into the well.

Referring now to FIG. 3, the traversal of an ESP around a radius or curved section of a well 8 is shown. The ESP comprises an electric motor 10, an equalizer 12, a centrifugal pump 14, the connected production tubing 16, and an electric cable 78 that is attached to the assembly from the motor to an above-ground power source.

Figure 4:
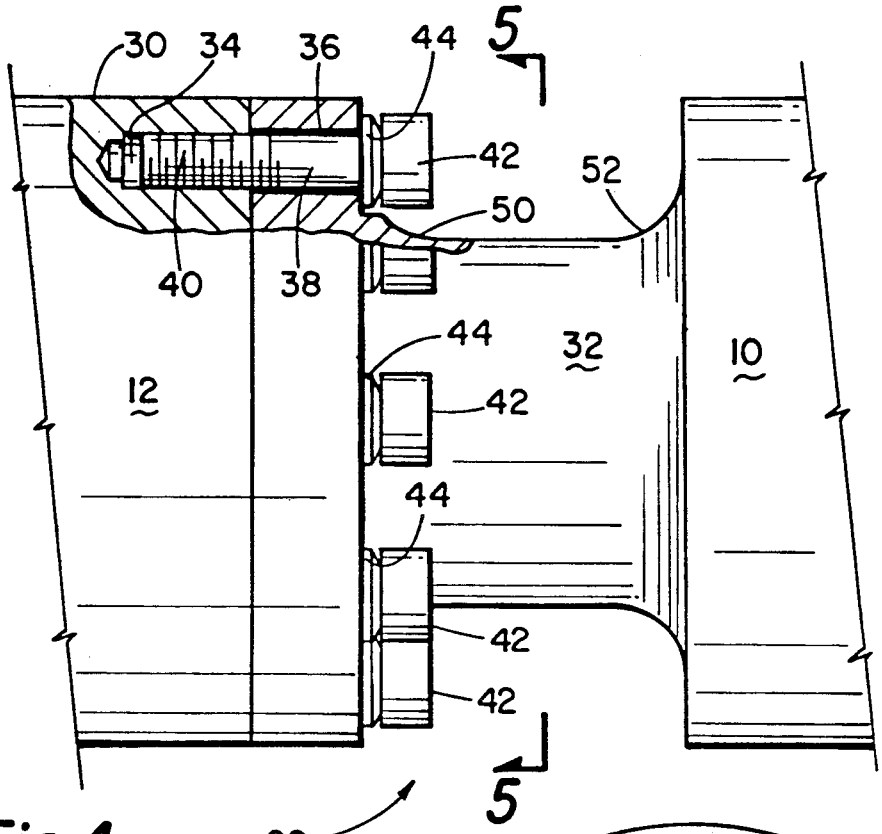
FIG. 4 is a partial elevational view of a flexible flange connection, partly in section, according to this invention.
Figure 5:
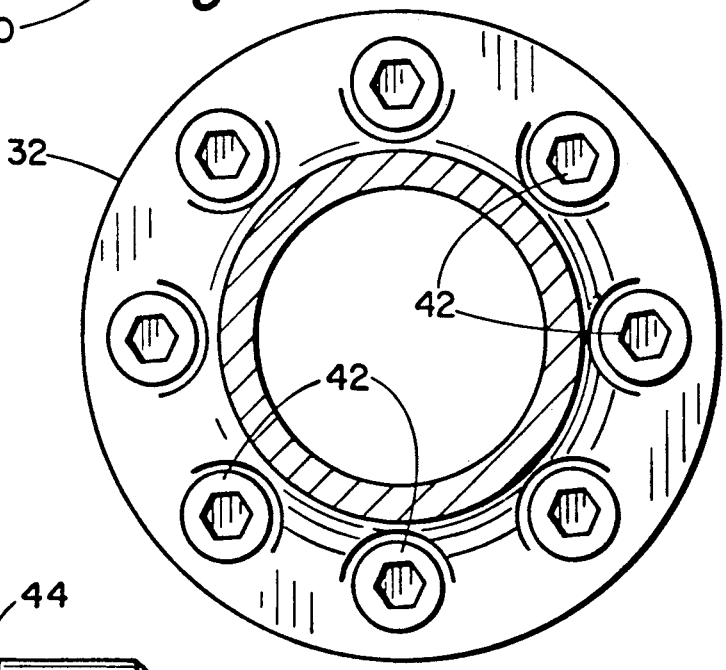
FIG. 5 is a sectional view taken along the line 5—5 of FIG. 4.
Figure 6:
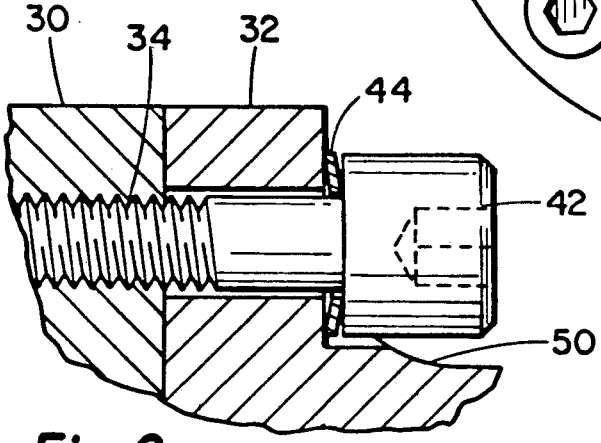
FIG. 6 is a partial sectional view of the bolted connection according to this invention.

Connecting each of the ESP units is a "flexible" flange joint generally designated by the numeral 20, which is aptly described in FIGS. 4–6. The joint comprises a first member 30, which may be a portion of a particular ESP unit, e.g., the bottom of the equalizer or the motor. A second member 32 of the joint 20 is formed as part of the next adjacent ESP unit, in this case the equalizer 10. The first member has a plurality of circumferentially spaced and threaded holes 34. The second member 32 of the flange joint has a plurality of circumferentially spaced holes 36 which are axially aligned with the holes 34 of the first member. A plurality of bolts 38 have a threaded portion 40 at one end and an enlarged bolt head 42 at the other end. A critical element to provide flexibility to the joint is the use of a Bellville spring 44, e.g. a flat spring washer beneath each bolt head. Each bolt is then torqued to that position where the Bellville spring is under yieldable compression. That is, the bolts are torqued sufficiently tight to unitize the ESP together so that it will function, yet yield, as the units traverse a curved portion of a well.

Although only one set of openings 36 and yieldable connections 40–44 are shown, the invention includes the use of a mirror image of flange 32 on the motor 10 side.

The joint 20 is also designed to have a low stress concentration factor, below 2.5. To achieve this, the flange connection includes a generous radius 50 and 52.

The flexible flange joint is designed to be slightly stronger than the bolts that hold it together. This makes the bolts the limiting factor in the design. The bending stress on the unit is translated into tension in the bolts. Because the bolts are arranged in a circle (bolt pattern), the bolt nearest the side of the unit that has the convex bend will have the greatest tension. The bolt on the concave side of the bend will have the least. This is depicted by the graph of FIG. 7. If the strength of the bolts is exceeded, the bolts will plastically deform, i.e. stretch, before they break. This plastic deformation allows other bolts to reach their elastic limit and therefore transmit the maximum bending to the unit. If the bolts have exceeded their elastic limit, they will be permanently deformed or stretched. It is necessary to include a device to make up for this deformation in order to keep the joint tight. This is accomplished by the use of the Bellville spring washers 44 under each of the bolt heads. If the bolt does stretch passing through the curve or bend, the Bellville washers will return the bolt to its original preload tension when the unit is straightened out.

Figure 9:
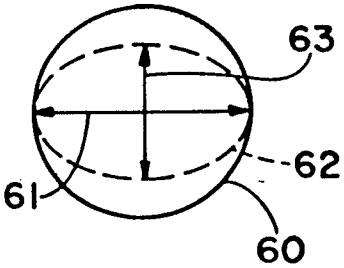
FIG. 9 is a view taken along the line 9—9 of FIG. 8.
Figure 8:
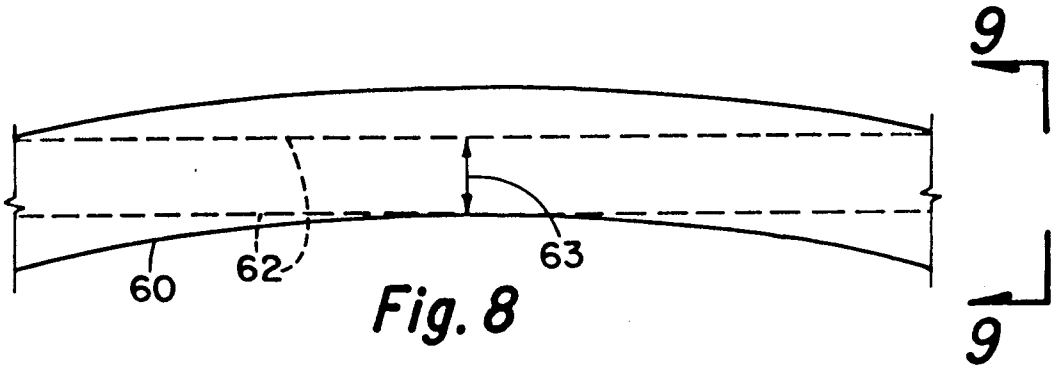
FIG. 8 is a partial diagrammatic view of a well bore at a deviated portion thereof.
Figure 10:
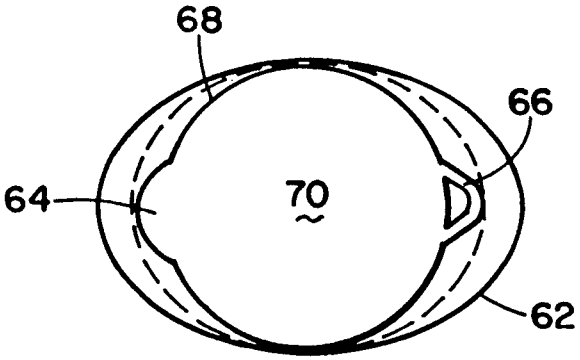
FIG. 10 is a diagrammatic section view depicting an effective ESP shape within the effective casing shape.

FIGS. 8, 9, and 10 depict what is defined herein as the effective casing or well bore shape which is important to the concepts of the use of the cable protecting rollover devices of this invention. The actual casing is indicated by the numeral 60, while the effective casing shape when viewed into the curve is shown by the dotted line 62. When so viewed, the effective shape is in the form of an ellipse or oval with a major diameter 61 and a minor diameter 63. With the effective shape of the casing being as thus described, then if the actual shape of the ESP were caused to be 'out of round', so to speak, the ESP will rotate in order to follow the path of least resistance. This then is the function of the rollover devices of this invention. The purpose is to place the rollover devices such that the cable side of an ESP is positioned or rotated to a position within the major diameter of the effective well bore shape and not pinched.

FIG. 10 depicts the 'effective shape' concept as an end view of the curve would appear with the ESP 70 and rollover devices 64 and 66 of this invention. Dotted line 68 indicates the effective shape of the ESP 70.

Figure 11:
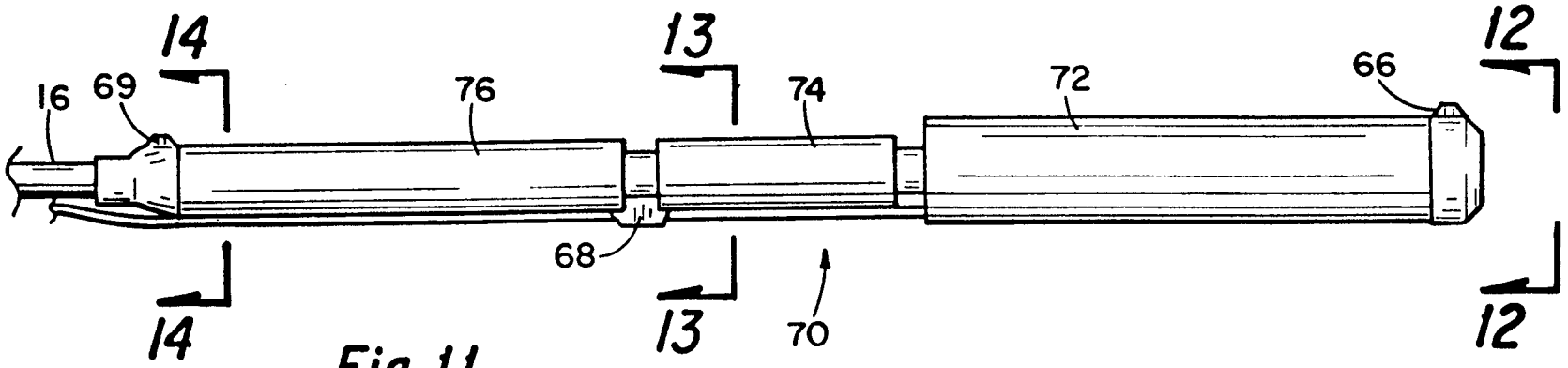
FIG. 11 is a side elevational view of a typical ESP and its attached cable with the rollover devices of this invention.
Figure 12:
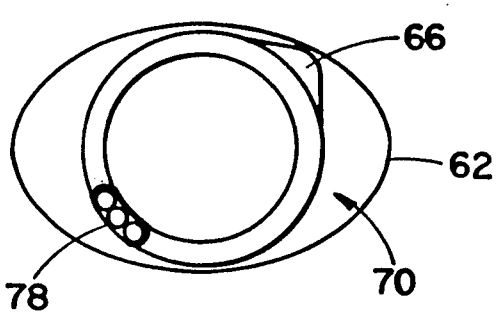
FIG. 12 is an end view taken along the line 12—12 of FIG. 11 depicting the rollover device at the motor end of the ESP.

FIG. 11 is a side elevational view of the assembled ESP of this invention combining a motor 72, equalizer 74, centrifugal pump 76, production tubing 16 along with the flexible joints 20 and the rollover devices 66, 68 and 69. Cable 78 is attached to one side of the assembled ESP. Rollover device 66 is a rounded cam-like protrusion that is positioned at the end of the motor on the side opposite the side of the cable which will cause a rolling motion to the ESP 70, as shown in FIG. 12. This forces the cable side into the major diameter 61 space away from any pinching along the minor axis 63 of the effective casing diameter.

Figure 13:
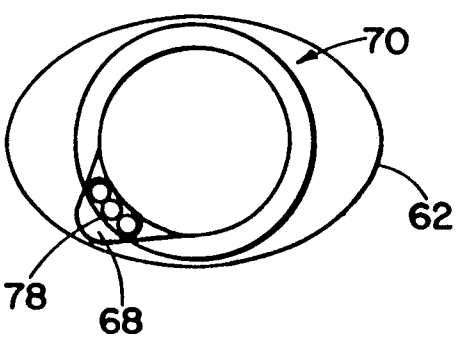
FIG. 13 is a sectional view taken along the line 13—13 of FIG. 11, depicting another form of rollover device as used in the intermediate portion of an ESP.
Figure 14:
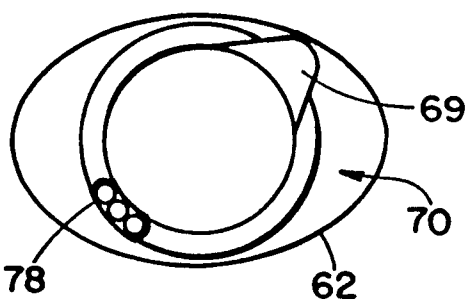
FIG. 14 is a sectional view taken along the line 14—14 of FIG. 11 depicting the rollover device located at the top or pump end of the ESP.
Figure 3:
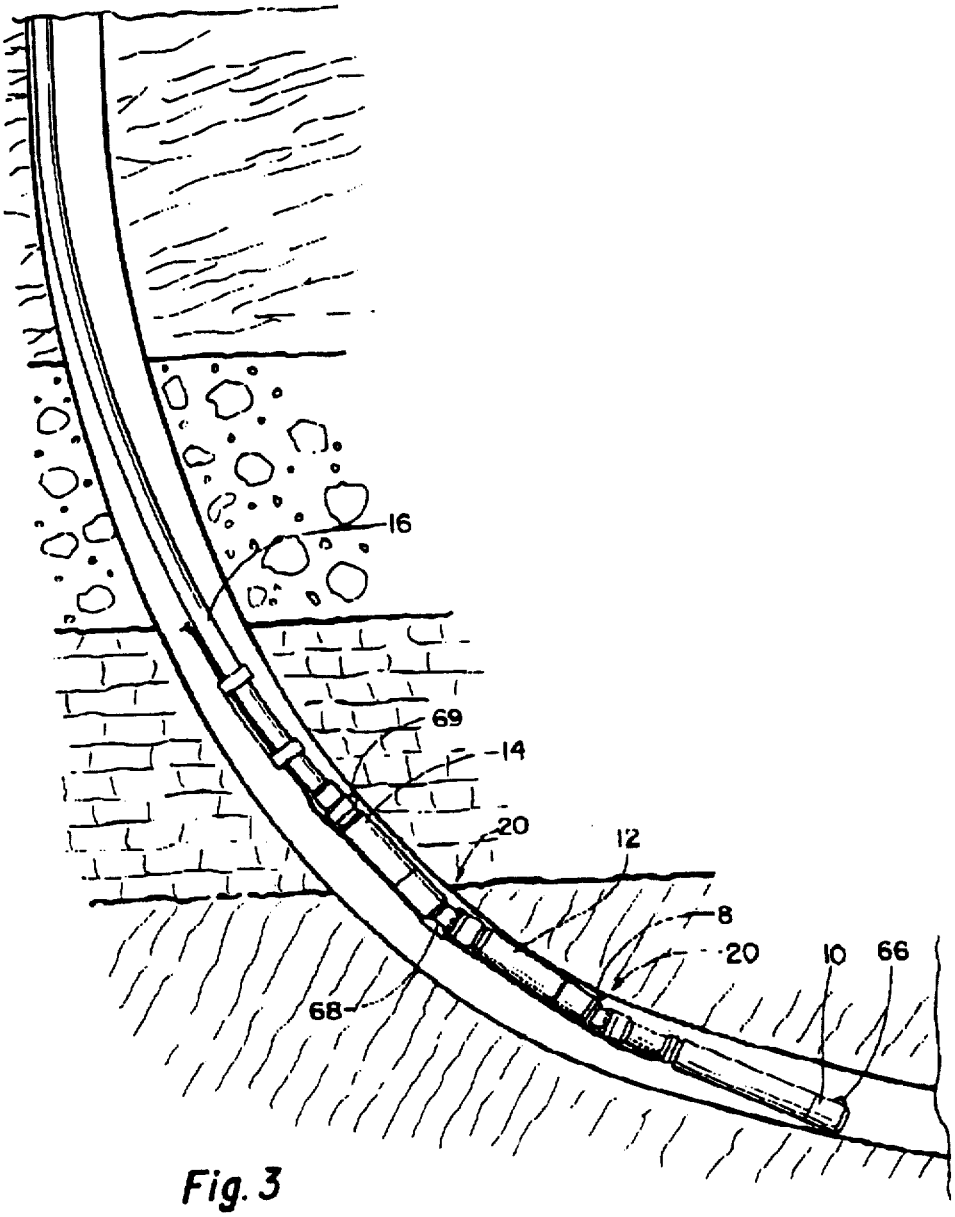
Figure 10:
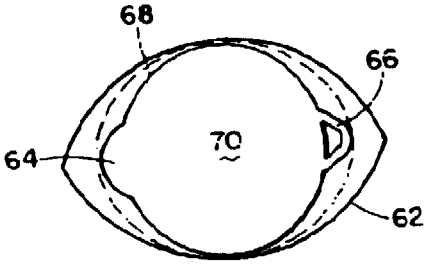
Figure 12:
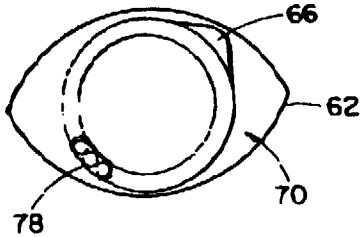
Figure 13:
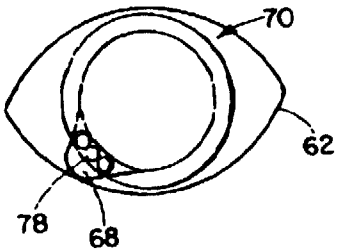
Figure 9:
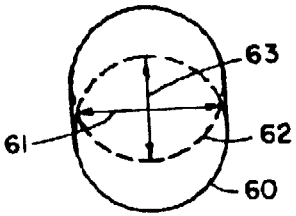
Figure 14:
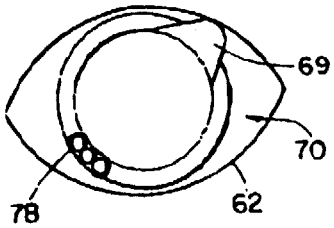

Another form of rollover cable protecting device for the central portion of the ESP is shown in FIG. 13. This device 68 is positioned on the cable side and encompasses the cable therein. Rollover device 69 is similar to the rounded cam-like protrusion 66 but formed at the pump 76 end to cause the rollover movement as shown in FIG. 14.

Figure 16:
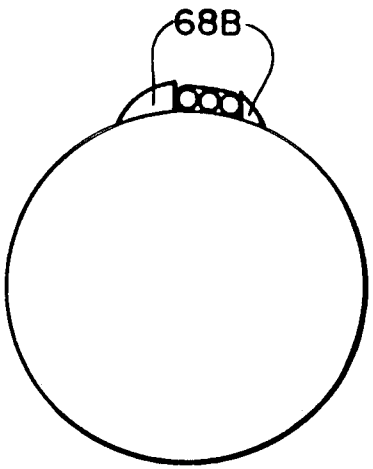
FIGS. 15 and 16 are sectional views of other types of rollover devices for the intermediate area of an ESP.
Figure 15:
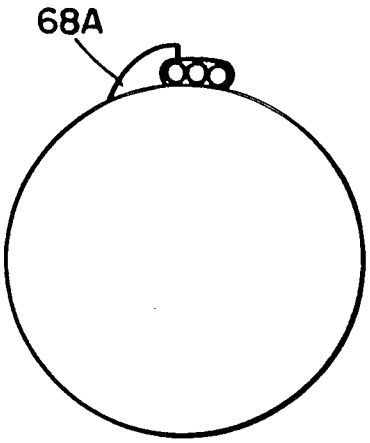

Other types of rollover devices 68A and 68B for the intermediate area are shown in FIGS. 15 and 16, all of which have provision for the cable to pass therethrough or protect the cable yet with a cam-like rounded surface to cause the rollover action herein described.

Any of the rollover protrusion devices can be used separately or in combination with the other described devices. Although three devices, 66, 68, and 69, are shown, any number of the devices may be used, including use with those portions of the production tubing 16 that will be caused to traverse the deviated or curved portion of a well. The basic purpose of the rollover devices are to make the position of the cable side of the ESP unstable so that there is a tendency to roll to a clear non-pinching side of the well bore or casing. The ability of the ESP to roll without exceeding any elastic deformation of the assembly or its parts is possible because a substantial length of a well tubing takes on the characteristics of a string as it is inserted into the well bore.

What is claimed:

1. An oil well production assembly comprised of a submersible electric motor unit, a pump unit, and a production tubing unit for insertion within or through skewed or deviated portions of a well bore, comprising;

a semi-flexible joint between at least two of said units, said joint comprising a bolted flange means connected to one of said units, a plurality of circumferentially spaced bolt holes in said flange means;

a plurality of circumferentially threaded bolt holes in said adjacent unit, said threaded bolt holes being co-axially aligned with said bolt holes in said bolted flange means;

a plurality of threaded bolts, each having a bolt head and a Bellville spring washer therebeneath, each said bolt being inserted through said bolt holes in said bolted flange means and threadably connected with said threaded bolt holes under sufficient torque to place said washer in yieldable compression between said bolt head and said bolted flange means.

2. An assembly of claim 3.wherein each said bolted flange means includes a smaller diameter section interconnecting said motor with said bolted flange means and radiused thereto outwardly at said interconnection with said bolted flange means and said motor and wherein each said bolt hole is surrounded by a flat shoulder to receive said spring washer.

3. An assembly of claim 1 wherein said semi-flexible joint is between said motor unit and said pump unit.

4. A submersible electric motor, pump, and production tubing assembly, said assembly comprised of a plurality of interconnected sections for insertion within or through skewed or deviated portions of a well bore, comprising:

a semi-flexible joint between each of said sections, each said joint comprising a bolted flange means connected to one of said sections, a plurality of circumferentially spaced bolt holes in said bolted flange means;

a plurality of circumferentially threaded bolt holes in a next adjacent section, said threaded bolt holes being coaxially aligned with said bolt holes in said bolted flange means;

a plurality of threaded bolts, each having a bolt head and a Bellville spring washer therebeneath, each said bolt being inserted through said bolt holes in said bolted flange means and threadably connected with said threaded bolt holes under sufficient torque to place said washer in yieldable compression between said bolt head and said bolted flange means.

5. An assembly of claim 4 wherein each said bolted flange means includes a smaller diameter section interconnecting said one section with said bolted flange means and radiused thereto outwardly at said interconnection with said bolted flange means and said section and wherein each said bolt hole is surrounded by a flat shoulder to receive said spring washer.

6. An assembled submersible electric motor section, an equalizer section, a pump section, and production tubing section for insertion within or through skewed portions of a well bore, comprising:

a semi-flexible joint between said motor and equalizer, between said equalizer and said pump, and between said pump ard said production tubing, each said joint comprising a bolted flange means connected to one said section, a plurality of circumferentially spaced bolt holes in said flange means;

a plurality of circumferentially threaded bolt holes in said next adjacent section, said threaded bolt holes being coaxially aligned with said bolt holes in said bolted flange means;

a plurality of threaded bolts, each having a bolt head and a Bellville spring washer therebeneath, each said bolt being inserted through said bolt holes in said bolted flange means and threadably connected with said threaded bolt holes in said next adjacent section under sufficient torque to place said washer in yieldable compression between said bolt head and said bolted flange means.

7. An assembly of claim 6 wherein each said bolted flange means includes a smaller diameter section interconnecting said section with said bolted flange means and radiused thereto outwardly at said interconnection with said bolted flange means and said section and wherein each said bolt hole is surrounded by a flat shoulder to receive said spring washer.

8. A longitudinal and rigidly connected assembly of a submersible electric motor section, an equalizer section, a pump section, production tubing section and an electrical power cable strung along one side of said assembly, said assembly adaptable for insertion within or through skewed portions of a well bore which, in a cross-section, define a major and smaller minor diameter, comprising:

a semi-flexible joint between said motor and equalizer, between said equalizer and said pump, and between said pump and said production tubig, each said joint comprising a bolted flange means connected to one said section, a plurality or circumferentially spaced bolt holes in said flange means;

a plurality of circumferentially threaded bolt holes in said next adjacent section, said threaded bolt holes being coaxially aligned with said bolt holes in said bolt flange means;

a plurality of threaded bolts, each having a bolt head and a Bellville spring washer therebeneath, each said bolt being inserted through said bolt holes in said bolted flange means and threadably connected with said threaded bolt holes in said next adjacent section under sufficient torque to place said washer in yieldable compression between said bolt head and said bolted flange means;

a cam means attached to said assembly to cause said one side of said assembly to partially rotate about its longitudinal axis to a position within said major axis when said cam means rubs against said skewed portions of said well bore while said assembly is being inserted into or retrieved from said well bore.

9. The assembly of claim 8 wherein said cam means is diametrically opposite said one side where said power cable is strung.

10. The assembly of claim 8 wherein said cam means includes a longitudinal opening for said cable.

11. The assembly of claim 8 wherein said cam means comprises a first cam adjacent the motor end of said assembly, a second cam adjacent the pump end of said assembly, and a third cam intermediate said first and second cams, said first and second cams being diametrically opposite said one side where said power cable is strung, said third cam being on the same side of said poer cable and including means therewith to protect said cable.

12. A longitudinal and rigidly connected assembly of an submersible electric motor, pump, a length of production tubing, and an electrical power cable strung along one side of said assembly thereof, said assembly adaptable for insertion within or through skewed portions of a well bore which, in cross-section transverse to the longitudinal axis of said well, defines a major dimension and smaller minor dimension, comprising in combination cam means attached to said assembly to cause, while said assembly is being inserted into or retrieved from said well bore, said one side of said assembly to partially and temporarily rotate or twist about its longitudinal axis, because of resistance to the bending by the assembly, to a position within said major dimension when said cam means rubs against said skewed portions of said well bore, and because of resistance to the bending by the assembly.

13. The assembly of claim 12 wherein said cam is diametrically opposite said one side where said power cable is strung.

14. The assembly of claim 12 wherein said cam means comprises a first cam adjacent the motor end of said assembly, a second cam adjacent the pump end of said assembly, and a third cam intermediate said first and second cams, and first and second cams being diametrically opposite said one side where said power cable is strung, said third cam being on the same side of said power cable and including means therewith to protect said cable.

15. The assembly of claim 12 wherein said cam means comprises a first cam adjacent a top end of said assembly, a second cam adjacent a bottom end of said assembly, and a third cam intermediate said first and second cams, said first and second cams being diametically opposite said one side where said power cable is strung, said third cam being on the same side of said power cable and including means therewith to protect said cable.

16. An assembled submersible electric motor section, an equalizer section, a pump section, and production tubing section for insertion within or through skewed portions of a well bore, comprising:

a semi-flexible joint between at least two of said sections, each said joint comprising a bolted flange means connected to one said section, a plurality of circumferentially spaced bolt holes in said flange means;

a plurality of circumferentially hreaded bolt holes in said next adjacent section, said threaded bolt holes being coaxially aligned with said bolt holes in said bolted flange means;

a plurality of threaded bolts, each having a bolt head and a Bellville spring washer therebeneath, each said bolt being inserted through said bolt holes in said bolted flange means and threadably connected with said threaded bolt holes in said next adjacent section under sufficient torque to place said washer in yieldable compression between said bolt head and said bolted flange means.

17. An assembly of claim 16 wherein each said bolted flange means includes a smaller diameter section interconnecting said section with said bolted flange means and radiused thereto outwardly at said interconnection with said bolted flange means and said section and wherein each said bolt hole is surrounded by a flat shoulder to receive said spring washer.

18. A longitudinal and rigidly connected assembly of a submersible electric motor section, an equalizer section, a pump section, and production tubing section and an electrical power cable strung along one side of said assembly, said assembly adaptable for insertion within or through skewed portions of a well bore which, in a cross-section, define a major and smaller minor diameter, comprising:

a semi-flexible joint between at least two of said sections, each said joint comprising a bolted flange means connected to one said section, a plurality of circumferentially spaced bolt holes in said flange means;

a plurality of circumferentially threaded bolt holes in said next adjacent section, said threaded bolt holes being coaxially aligned with said bolt holes ins aid bolt flange means;

a plurality of threaded bolts, each having a bolt head and a Bellville spring washer therebeneath, each said bolt being inserted through said bolt holes in said bolted flange means and threadably connected with said threaded bolt holes in said next adjacent section under sufficient torque to place said washer in yieldable compression between said bolt head and said bolted flange means;

a cam means attached to said assembly to cause said one side of said assembly to partially rotate about its longitudinal axis to a position within said major axis when said cam means rubs against said skewed portions of said well bore while said assembly is being inserted into or retrieved from said well bore.

19. The assembly of claim 18 wherein said cam means is diametrically opposite said one side where said power cable is strung.

20. The assembly of claim 18 wherein said cam means includes a longitudinal opening of for said cable.

21. The assembly of claim 18 wherein said cam means comprises a first cam adjacent the motor end of said assembly, a second cam adjacent the pump end of said assembly, and a third cam intermediate said first and second cams, said first and second cams being diametrically opposite said one side where power cable is strung, said third cam being on the same side of said power cable and including means therewith to protect said cable.

22. A well fluid production assembly comprising a submersible electric motor unit, a pump unit, and a production tubing unit for insertion within or through skewed or deviated portions of a well bore, comprising:

a semi-flexible joint between at least two of said units, said joint comprising a bolted flange means connected to one of said units, a plurality of circumferentially spaced bolt holes in said flange means;

a plurality of circumferentially threaded bolt holds in said adjacent unit, said bolt holes being co-axially aligned with said bolt holes in said bolted flange means;

a plurality of threaded bolts, each having a bolt head and a Bellville spring washer therebeneath, each said bolt being inserted through said bolt holes in said bolted flange means and threadably connected with said threaded bolt holes under sufficient torque to place said washer in yieldable compression between said bolt head and said bolted flange means.

23. An assembly of claim 22 wherein each said bolted flange means includes a smaller diameter section interconnecting said motor with said bolted flange means and radiused thereto outwardly at said interconnection with said bolted flange means and said motor and wherein each said bolt hole is surrounded by a flat shoulder to receive said spring washer.

* * * * *

UNITED STATES PATENT AND TRADEMARK OFFICE

CERTIFICATE OF CORRECTION

PATENT NO. : 5,129,452

DATED : July 14, 1992

INVENTOR(S) : Brown L. Wilson

It is certified that error appears in the above—identified patent and that said Letters Patent is hereby corrected as shown below:

Title page should be deleted to appear as per attached title page.

Delete Figure 3 and substitute attached Figure 3 which has been revised to show ESP touching the deviated well bore at the lower end of the curve.

Delete Figures 9, 10, 12, 13 and 14 and substitute attached Figures 9, 10, 12, 13 and 14 which have been revised to show the cross section of the bore hole as the intersection of two circles.

Column 5, line 3, change "ellipse or oval" to --intersection of two circles--.

Signed and Sealed this

Nineteenth Day of October, 1993

*Attest:*

*Attesting Officer*

BRUCE LEHMAN

*Commissioner of Patents and Trademarks*

United States Patent [19]

Wilson

[11] Patent Number: 5,129,452

[45] Date of Patent: Jul. 14, 1992

[54] FLEXIBLE ELECTRICAL SUBMERSIBLE MOTOR PUMP SYSTEM FOR DEVIATED WELLS

[75] Inventor: Brown L. Wilson, Tulsa, Okla.

[73] Assignee: Oil Dynamics, Inc., Tulsa, Okla.

[21] Appl. No.: 734,064

[22] Filed: Jul. 22, 1991

Related U.S. Application Data

[63] Continuation of Ser. No. 483,642, Feb. 23, 1990, abandoned.

[51] Int. Cl.[5] ..... E21B 17/02

[52] U.S. Cl. ..... 166/66.4; 166/242; 285/363

[58] Field of Search ..... 166/242, 65.1, 66.4, 166/105, 243; 285/89, 340, 363, 405

[56] References Cited

U.S. PATENT DOCUMENTS

| | | | |
|---|---|---|---|
| 2,943,870 | 7/1960 | Davis | 285/363 |
| 3,624,822 | 11/1971 | Carle | 166/105.5 |
| 3,650,550 | 3/1972 | West | 285/363 |
| 4,616,704 | 10/1986 | Johnston | 166/242 |
| 4,753,291 | 6/1988 | Smith et al. | 166/65.1 |
| 4,771,830 | 9/1988 | Peate | 166/250 |

*Primary Examiner*—Terry Lee Melius
*Attorney, Agent, or Firm*—Head & Johnson

[57] ABSTRACT

Apparatus is provided to protect an electric submersible motor/pump (ESP) assembly as the normally rigid assembly is inserted into deviated or curved subterranean wells, i.e. directionally or horizontally drilled wells, which apparatus includes flexible joint connection means and cable protection devices.

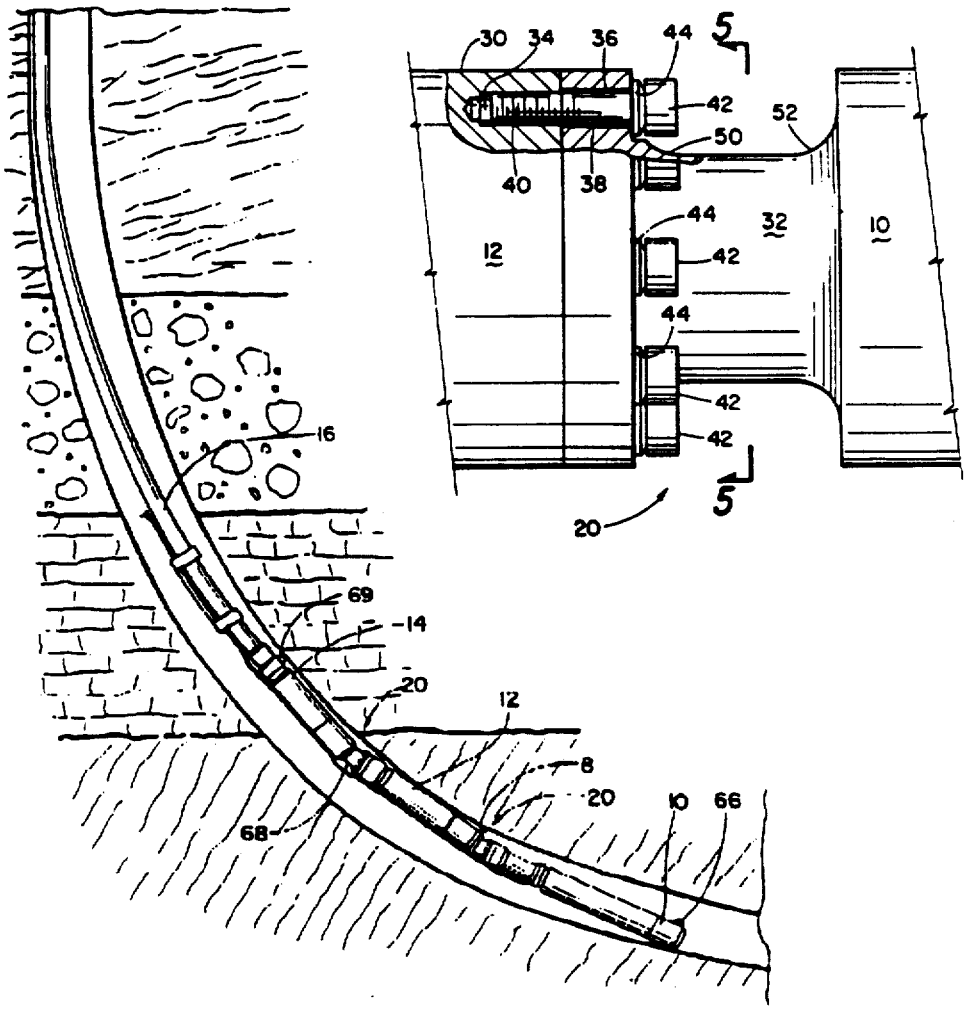

23 Claims, 5 Drawing Sheets